United States Patent [19]

Honkura et al.

[11] Patent Number: 5,017,247

[45] Date of Patent: May 21, 1991

[54] RARE EARTH MAGNET ALLOY

[75] Inventors: Yoshinobu Honkura; Yasuji Fukui; Tooru Matsuo; Chisato Mishima, all of Tokai, Japan

[73] Assignee: Aichi Steel Works, Limited, Aichi, Japan

[21] Appl. No.: 457,041

[22] Filed: Dec. 26, 1989

[30] Foreign Application Priority Data

| | | | |
|---|---|---|---|
| Dec. 26, 1988 | [JP] | Japan | 63-328621 |
| Mar. 31, 1989 | [JP] | Japan | 63-82536 |
| Mar. 31, 1989 | [JP] | Japan | 63-82537 |

[51] Int. Cl.[5] ..... H01F 1/053

[52] U.S. Cl. ..... 148/302; 420/83; 420/121

[58] Field of Search ..... 148/301, 302; 420/83, 420/121

[56] References Cited

FOREIGN PATENT DOCUMENTS

| | | | |
|---|---|---|---|
| 0175214 | 3/1986 | European Pat. Off. | 148/302 |
| 60-66802 | 4/1985 | Japan | 148/302 |

*Primary Examiner*—John P. Sheehan

*Attorney, Agent, or Firm*—Blum Kaplan

[57] ABSTRACT

A rare earth magnet alloy including, by weight, 8 to 20% of Sm, 6 to 20% of one or more of elements selected from the group consisting of Nd, Pr and Y, 10 to 25% of Fe, 5 to 10% of Cu, 0.1 to 1% of Ti, 1 to 4% of Zr, 0.1 to 1.0% of Mn, 0.003 to 0.015% of B, optional amount of Ce and the balance of Co, in which the total sum for the amount of Nd, Pr, Y and Ce and the amount of Sm is from 22 to 28%. P and/or S may be added instead of or together with B. The magnet alloy has the coercive force of greater than 10 KOe, the residual magnetic flux density of greater than 10.5 KG and the maximum energy product of about 28 MGOe.

42 Claims, 3 Drawing Sheets

RARE EARTH MAGNET ALLOY

BACKGROUND OF THE INVENTION

1. Field of the Invention

The present invention relates to a permanent magnet alloy material and, more particularly, to a multi-component rare earth magnet alloy belonging to 2–17 type Sm-Co magnets among rare earth magnet alloys.

2. Description of the Prior Art

Permanent magnets are generally utilized for various apparatus such as rotational appliances, and communication, measuring and acoustic apparatus. It is desirable that a permanent magnet has great residual magnetic flux density (Br), coercive force (Hc) and maximum magnetic energy product (BHmax) respectively and can stably maintain magnetic property. Since a predetermined level of magnetic fields can be obtained with a small volume by using a magnet of greater maximum magnetic energy product (BHmax), it is possible to reduce the size and the weight of the appliances.

At the initial stage of using KS steels for permanent magnet material, Alnico magnetic and ferrite magnet have been used long since and, owing to the subsequent study for the rare earth magnets and the development of $SmCo_5$ sintered magnets, the maximum energy product of the magnet has been improved outstandingly. $SmCo_5$ is referred to as a 1–5 type magnet, which is an intermetallic compound present in Sm-Co binary series and it has a saturation magnetic flux density (Bs) as high as 9.0 KG and the maximum energy product of up to 20 MGOe.

Then, an earnest effort has been made for the development of magnets having more excellent magnetic property than $SmCo_5$, and rare earth magnets utilizing a $Sm_2Co_{17}$ compound having Bs value of as high as 12.8 KG has been developed. The magnets of this type are collectively referred to as a 2–17 type magnet which are rare earth magnets typically represented by Sm (Co, Fe, Cu)$_{6.8}$ and Sm (Co, Fe, Cu, Zr)$_{7.4}$, which have high maximum energy product (BHmax) of about 30 MGOe and intrinsic coercivity iHc of greater than 10 KOe.

However, Sm in the rare earth metal is expensive and the resource therefor has almost been drained and, accordingly, it is difficult to be available. In view of the above, for obtaining inexpensive magnets, it has been proposed rare earth magnets in which Sm in the conventional rare earth magnet is partially substituted with Nd, Ce and Pr which are abundant in view of the resource. The magnets have the maximum energy product of about 24 MGOe and the coercive force bHc of 7.6 KOe (iHc of about 9 KOe: JPA No. 62-243731, Official Gazette), and both of the maximum energy product and the coercive force are lower than those of Sm-Co-Fe-Cu-Zr alloy, multi-component rare earth alloy belonging to Sm-Co magnets.

Further, with the same reason, it has also been proposed a rare earth magnet in which Sm is partially substituted with Ce and further incorporated with Zr and B. The proposed magnet has the maximum energy product of about 24 MGOe and the coercive force iHc of about 13 KOe (JPA No. 63-28844, Official Gazette). However, it has not yet been produced and marketed. As commercially available magnet of SiCe series, it has only been put to practical use of those having the maximum energy product of about 22 MGOe and the coercive force iHc of about 9 KOe and both of the maximum energy product and the coercive force are lower as compared with those of Sm-Co-Fe-Cu-Zr series alloys. It is supposed to be attributable to the difficulty in view of the production such as sintering property. Accordingly, in rare earth magnet alloys, it has been desired that they are inexpensive and have large coercive force and maximum energy product.

However, when it is intended to obtain an inexpensive rare earth magnet alloy by substituting expensive Sm with Nd, Ce, etc. which are abundant in view of natural resource, it is only possible to produce those having the maximum energy product of at most about 2 MGOe and the coercive force iHc of about 9 KOe as has been described above in the patent literature.

SUMMARY OF THE INVENTION

It is an object of the present invention to provide, in multi-component rare earth magnet alloys belonging to Sm-Co magnets, a rare earth magnet alloy of a reduced cost and excellent both in the coercive force and the maximum energy product, by substituting expensive Sm partially with Nd, Pr, or Y.

It is another object of the present invention to provide, in the rare earth magnet alloys described above, a Sm-Co-Fe-Cu-Zr series rare earth magnet alloy in which Sm is partially substituted with Nd, Pr and Y and, further, other additives such as B, P, S, etc. are also added.

The rare earth magnet alloy according to the present invention comprises, by weight 8 to 20% of Sm, 6 to 20% of one or more of elements selected from the group consisting of Nd, Pr and Y, 10 to 25% of Fe, 5 to 10% of Cu, 1 to 4% of Zr, 0.1 to 1% of Mn, 0.1 to 1% of Ti, 0.003 to 0.015% of B and the balance of Co, in which the total sum for the amount of the element selected from the group consisting of Nd, Pr and Y and the amount of Sm is within the range from 22 to 28%.

In the rare earth magnet alloy according to the present invention, from 0.003 to 0.015% of P and/or S may be contained instead of B. Further, in the rare earth magnet alloy according to the present invention, less than 5% by weight of Ce may be contained and the total sum for the amount of the elements selected from the group consisting of Nd, Pr and Y and the amount of Sm and Ce may be within a range from 22 to 28%.

In the rare earth magnet alloy according to the present invention, Mn, Ti, B, P and S are added in combination in a multi-component series rare earth magnet alloy belonging to 2–17 type Sm-Co magnets, thereby substituting a portion of expensive Sm with Nd, Pr, Y to reduce the Sm content, as well as finding a range of a composition for Fe, Cu, Zr and a rare earth metal showing a excellent magnetic property. The rare earth magnet alloy according to the present invention is inexpensive and of excellent magnet property having the coercive force of not less than 10 KOe, the residual magnetic flux density of greater than 10.5 KG and the maximum energy product of about 28 MGOe.

DETAILED DESCRIPTION OF THE PREFERRED EMBODIMENTS

The theoretical upper limit value of the maximum energy product in a magnet alloy is represented by $(4\pi Is)^2/4$, in which $4\pi Is$ is a saturation magnet flux density.

Figure 1:
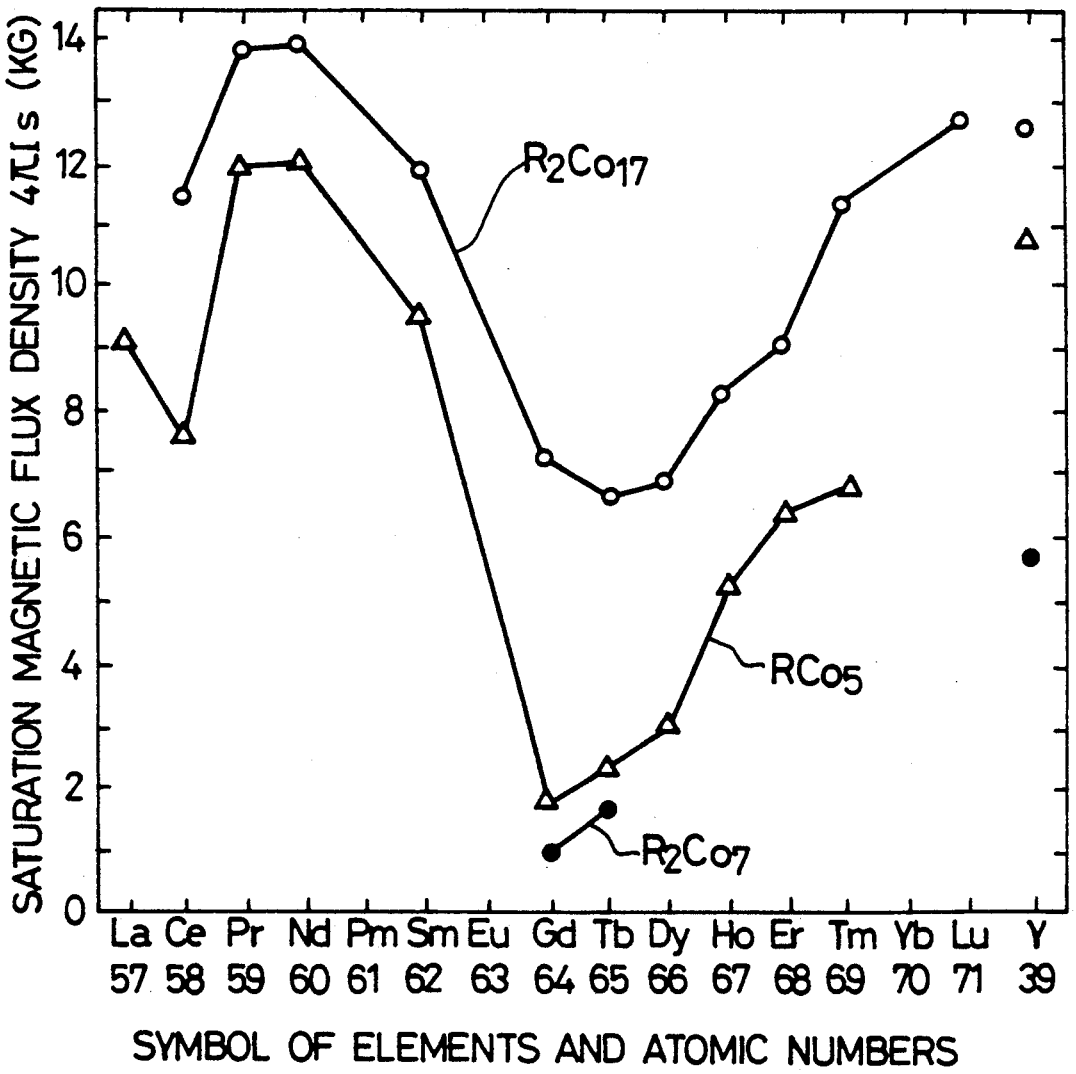
FIG. 1 is a diagram showing the saturation magnetic flux density of various kinds of rare earth metal-cobalt compounds at a room temperature.
Figure 2:
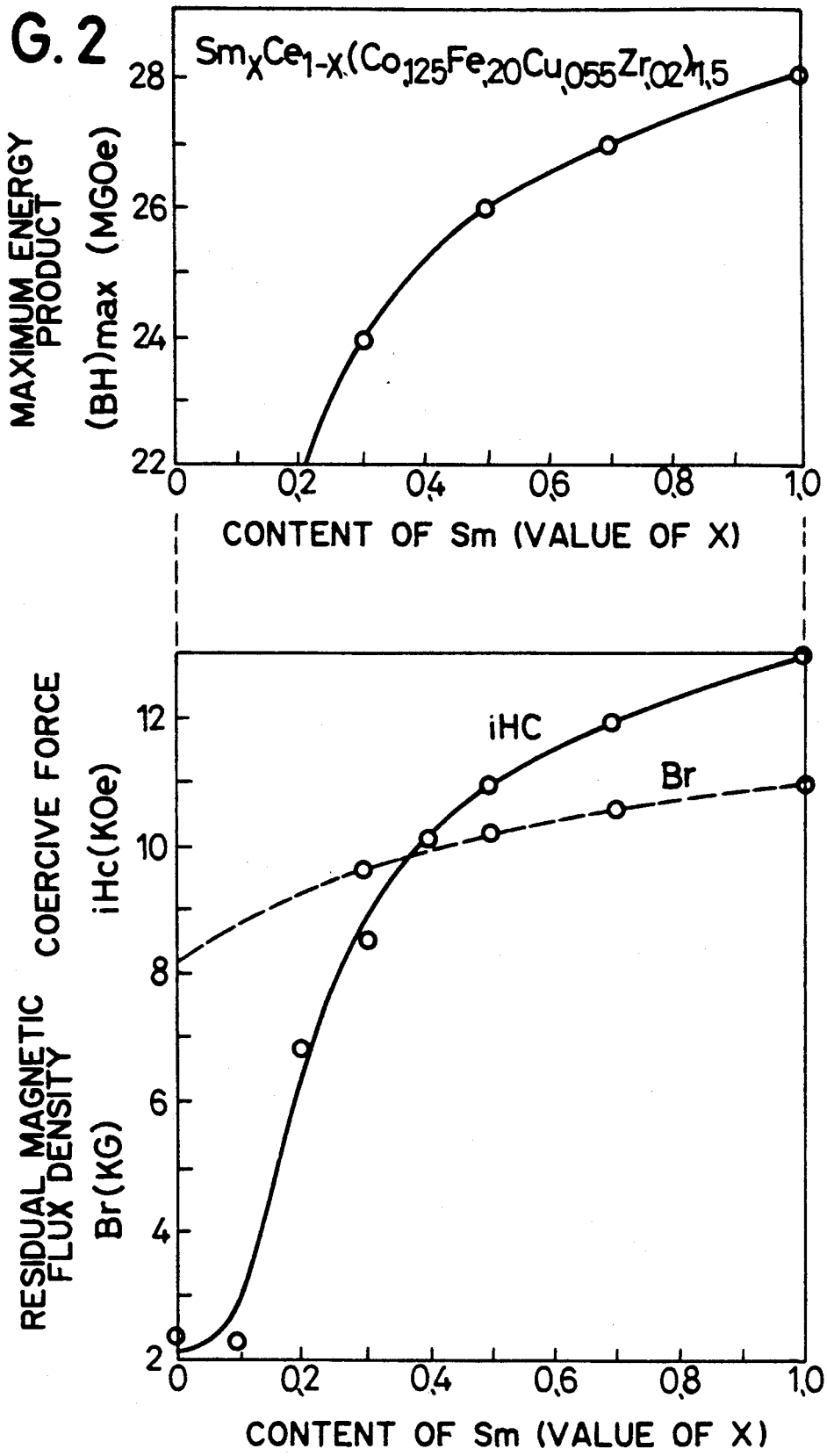
FIG. 2 is a diagram illustrating a relationship between the amount of Sm and the maximum energy product, the coercive force and the residual magnetic flux density in conventional Ce-substituted type magnet alloy.

FIG. 1 shows Strnat's research result showing the saturateion magnetic flux density for various kinds of rare earth cobalt compounds $R_2Co_{17}$, $RCo_5$, $R_2Co_7$ (R represents a rare earth elements) at a room temperature (Proc, 1972, INTERMAG Conf., Kyoto, Japan, (1972), April, P-511). FIG. 2 shows the change of Br (residual magnetic flux density), iHc (coercive force) and maximum energy product (BHmax) when the value x is varied in a rare earth magnetic alloy represented by: $Sm_x\ Ce_{1-x}\ (Co_{0.725}\ Fe_{0.20}\ Cu_{0.055}\ Zr_{0.02})_{7.5}$ (Journal of Applied Magnetic Society of Japan, Vol. 9, No. 1, 1985). As shown in FIGS. 1 and 2, since the $Ce_2Co_{17}$ compound has a lower saturation magnetic flux density as compared with $Sm_2Co_{17}$ compound, it is inevitable that the maximum energy product is lowered in the rare earth magnet alloy in which Sm is substituted with Ce.

Figure 3:
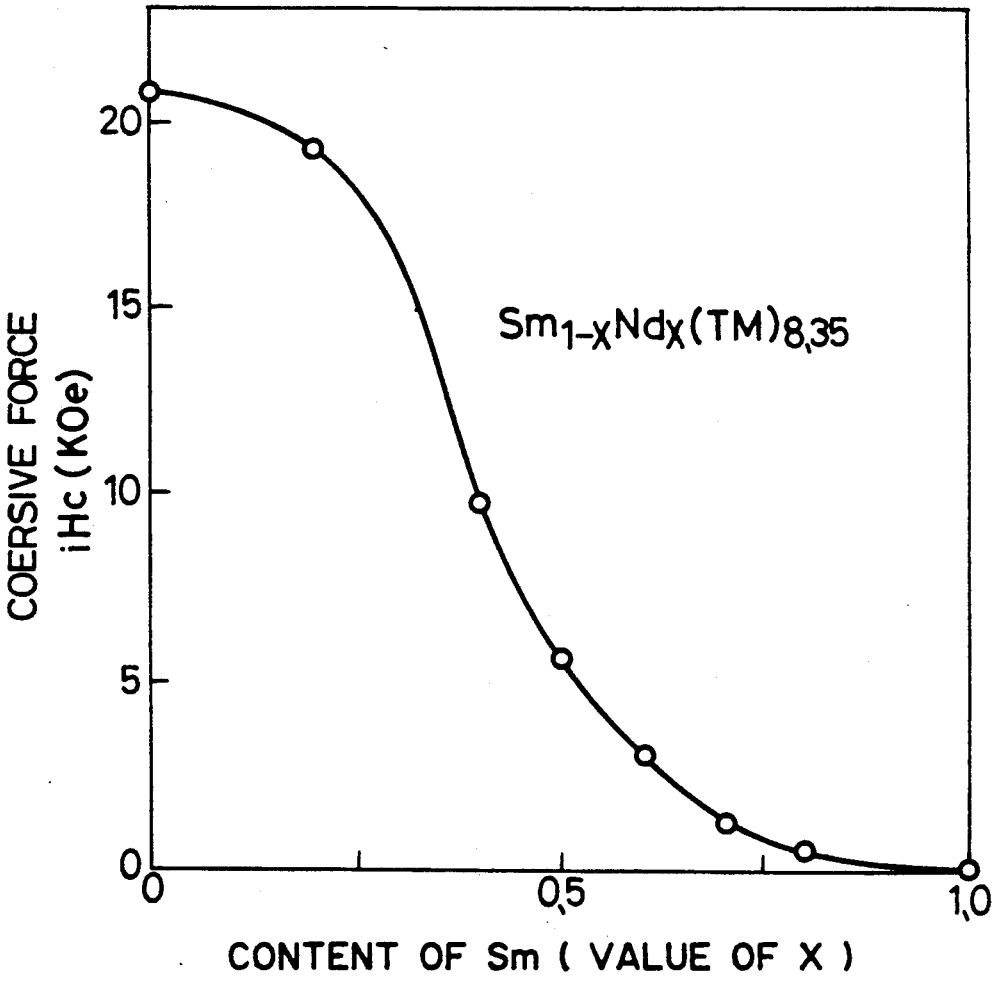
FIG. 3 is a diagram showing a relationship between the Nd amount and the coercive force in conventional Nd-substituted magnet alloy.

On the other hand, if Sm is substituted with Nd, Pr or Y, since the $Nd_2Co_{17}$ compound, $Pr_2Co_{17}$ compound or $Y_2Co_7$ compound has a higher saturation magnetic flux density as compared with $Sm_2Co_{17}$ compound (refer to FIG. 1), increase in the saturation magnetic flux density of the alloy and the improvement of the maximum energy product can be expected. However, in the prior art as described above, since this results in abrupt reduction in the coercive force (refer to FIG. 3) and the reduction in the squareness of the demagnetization curve, no great maximum energy product can be obtained. FIG. 3 shows a diagram illustrating the change of the coercive force when the value x is varied for the rare earth alloy of $Sm_{1-x}Nd_x\ (Co_{0.672}Cu_{0.08}Fe_{0.22}Zr_{0.028})_{8.35}$ (Journal of Applied Magnetic Society of Japan, Vol 11, No. 2, 1987).

Based on the above-mentioned finding, the present inventors have taken notice of the rare earth magnet alloy in which Sm is substituted with Nd, Pr or Y and made a study and, as a result, have accomplished the present invention by adding Mn-Ti-B, Mn-Ti-P or Mn-Ti-S in combination and defining the amount for each of the components in the alloy, that is, the amount for Sm, Fe, Cu and Zr and the amount of one or more of Nd, Pr and Y within a specific range. The reasons for the limitations of the contents of the components in the rare earth magnet alloy according to the present invention will be described hereinafter. Sm: 8–20%

Sm is an element that constitutes, together with Nd, Pr and Y, a main component of the rare earth magnet alloy according to the present invention and gives an influence on the property of the maximum energy product and the coercive force. Sufficient maximum energy product and coercive force can not be obtained if Sm content is less than 8%. On the other hand, if Sm content exceeds 20%, the cost is increased and there is no merit in view of resource saving. Nd, Pr, Y: 6–20%

Nd, Pr and Y are abundant in natural resources than Sm and can reduce the cost of the rare earth magnet alloy, by Sm being substituted with Nd. Pr and Y. Sufficient effect can not be obtained if it is less than 6%. On the other hand, if the elements are added in excess of 20%, the maximum energy product and the coercive force are rapidly reduced. Thus, the upper limit is defined as 20%. Fe: 10–25%

Sufficient residual magnetic flux density and maximum energy product can not be obtained if Fe content is less than 10%, the lower limit is defined as 10%. Further, if the Fe content exceeds 25%, sufficient coercive force can not be obtained, thus the upper limit is defined as 25%. Cu: 5–10%:

Sufficient coercive force can not be obtained if Cu is less than 5%, thus the lower limit is defined as 5%. On the other hand, the residual magnetic flux density and the maximum energy product are reduced if the Cu amount exceeds 10%, thus the upper limit is defined as 10%. Zr: 1–4%

Sufficient coercive force can not be obtained if the amount of Zr are less than 1%, thus the lower limit is defined as 1%. However, both of the residual magnetic flux density and the maximum energy product are reduced if Zr is contained in excess of 4%, thus the upper limit is defined as 4%. Mn: 0.1–1%

Mn plays a role in improving the homogenity of the alloy matrix at the time of solid solution treatment of the rare earth magnet alloy, by which a sufficient amount of Zr can be solid-solubilized into the matrix. The effect can be obtained only when Mn, is added together with Ti and B or P or S, and addition of Mn alone less contributes to the magnetic property. Sufficient improvement can not be obtained for the magnetic property if Mn content is less than 0.1%, the lower limit is defined as 0.1%. Further, the maximum energy product is reduced if Mn content exceeds 1%, then the upper limit is defined as 1%. Ti: 0.1–1%

It is considered that Ti increases the deposition of the $(Sm, Nd, Pr, Y)_2\ (Co, Fe, Cu)_7$ phase (hereinafter referred to as the 2–7 phase), thereby contributing to the improvement of the coercive force. However, if Ti is added alone, the squareness of the demagnetization curve is deteriorated. And, thereof the maximum energy product is lowered. Then, if Ti content is less than 0.1%, there is less effect for the improvement of the magnetic property. On the other hand, if Ti content exceeds 1%, the maximum energy product is lowered. B: 0.003–0.015%

B is an element which play a role to prevent a coarse 2–7 phase from precipitating not homogenously to the grain boundary and subgrain boundary but cause a fine 2–7 phase to precipitate homogenously over the entire alloy matrix. Accordingly, squareness of the demagnetization curve can be improved and the maximum energy product is improved. However, if B is added alone, the maximum energy product and the coercive force are reduced. If B content is less than 0.003%, there is less effect for improving the magnetic property and the matrix. On the other hand, if B content exceeds 0.015%, the coercive force is remarkably reduced. P, S: 0.003–0.015%

Each of the elements plays a role to prevent a coarse 2–7 phase from precipitating not homogenously to the grain boundary and sub-grain boundary but cause fine 2–7 phase to precipitate homogenously over the entire alloy matrix. Accordingly, the squareness of the demagnetization curve can be improved and the maximum energy product is improved. However, if P or S is added alone, the maximum energy product and the coercive force are reduced. If content of P and/or S is less than 0.003%, there is less effect for improving the magnetic property and the matrix. On the other hand, if content of P and/or S exceeds 0.015%, the coercive force is remarkably reduced. Ce: less than 5%.

In the present invention, Ce can be added together with one or more of Sm, Nd, Pr and Y, cost of the rare earth magnet alloy can be reduced. However, if Ce content exceeds 5%, the coercive force and the maximum energy product are reduced. Total amount for rare earth metals: 22–28%.

If the total amount of the rare earth metals is less than 22%, the maximum energy product and the coercive force required as the rare earth magnet can not be obtained. Further, if content of rare earth metals is in excess of 28%, the residual magnetic flux density and the maximum energy product are reduced.

In the present invention, Sm which is expensive and now about to be exhausted in view of nature resource is partially substituted with Nd, Pr or Y and Mn, Ti and B, P or S are added together in combination. It is, accordingly, possible to provide a rare earth magnet alloy which is inexpensive and excellent in the coercive force and the maximum energy product.

It is considered that the rare earth magnet according to the present invention can provide such excellent effect with the reasons as described below.

In the Sm-Co-Fe-Cu-Zr series rare earth magnet alloy shown in the prior art, a fine cell structure comprising a $Sm_2Co_{17}$ phase (2–17 phase) being surrounded with a $SmCo_5$ phase (1–5 phase) is formed by applying solid solution treatment and, thereafter, aging treatment in which magnetic walls are pin-secured, in other words, are secured by means of precipitation products to provide a great coercive force. On the other hand, in the conventional Nd-substituted magnet alloy, no sufficient coercive force was obtained even when the cell structure was formed.

The reason is assumed as below. That is, according to Livingstone's description [J. Appl. Phys. 48 (1977), 1350], the coercive force of the 2-phase structure comprising a 2–17 phase and a 1–5 phase, is in proportion with the difference of the magnetic wall energy between the 2–17 phase and the 1–5 phase. Then, if Sm is substituted with Nd or Pr or Y, the magnetic wall energy both in the 2–17 phase and the 1–5 phase is reduced and the difference therebetween is also lowered, to lower the coercive force. Along with the reduction in the coercive force, due to the reduction in the squareness of the demagnetization curve, the maximum energy product is reduced.

On the contrary, in the Nd-substituted Pr-substituted and Y-substituted magnet alloys according to the present invention, both of the coercive force and the maximum energy product are remarkably improved as compared with the conventional Nd-substituted magnet alloy. Although the mechanism has not yet been apparent at present, it is assumed as below. That is, in the magnet alloy according to the present invention, magnetic walls are firmly pin-secured by attaining fine and homogenous deposition of a Zr, Ti-enriched (Sm, Nd, Pr, Y)$_2$ (Co, Fe, Cu)$_7$ phase superimposed with fine cellular structure. Thus, the coercive force is increased and the squareness of the demagnetization curve is improved, which enables a remarkable improvement in the maximum energy product.

Various rare earth magnet alloys including the rare earth magnet alloys according to the present invention were manufactured and magnetic properties thereof were measured.

That is, starting metal materials at predetermined ratio were mixed and melted each at a ratio shown in Tables 1 and 2, and the resultant magnet alloys were pulverized into 2–5 μm average grain size, applied with press molding under a magnetic field of 10 KG, sintered at 1150°–1200° C. for 2–4 hours and then applied with a solid solution treatment at a temperature lower by 20°–40° C. than the sintering temperature for 2–6 hours. Then, an aging treatment was applied at 750°–900° C., annealed at 0.5°–5° C./min down to 400° C. and then further quenched. The variation of the production conditions is due to the difference of the optimum conditions for the magnet property depending on the alloy compositions.

The magnetic property of the resultant magnet alloy, that is, coercive force [iHc (KOe)], residual magnetic flux density [Br (KG)], maximum energy product [BHmax (MGOe)] are shown in Tables 1 and 2. In the table, indication for the amount of Co (balance) is omitted.

Nos. A01–A42 magnet alloys shown in Table 1 are examples of magnet alloys according to the present invention. Further, the Nos. B01–B31 magnet alloys shown in Table 2 are examples of magnet alloys manufactured for comparison and No. C01 shows the prior art (Example 1 in JPA No. 62-243731, Official Gazette).

As can be seen from Tables 1 and 2, according to the present invention, rare earth magnet alloy having coercive force of greater than 10 KOe, residual magnetic flux density of greater than 10.5 KG and maximum energy product of about 28 MGOe can be obtained.

TABLE 1

[Examples]

| | Chemical Composition (wt %) | | | | | | | | | | | | | | Magnetic Properties | | |
|---|---|---|---|---|---|---|---|---|---|---|---|---|---|---|---|---|---|
| No | Sm | Nd | Pr | Y | Fe | Cu | Zr | Hf | Mn | Ti | B | P | S | Others | iHe (KOe) | Br (KG) | BHmax (MGOe) |
| A01 | 13.5 | 12.5 | | | 15 | 7.5 | 2.7 | | 0.5 | 0.4 | 0.008 | | | | 11.8 | 10.9 | 28.8 |
| A02 | 18.5 | 6.5 | | | 18 | 6 | 2.5 | | 0.6 | 0.6 | 0.005 | | | | 13.3 | 11.1 | 29.5 |
| A03 | 9 | 16 | | | 14.5 | 8 | 3.0 | | 0.3 | 0.5 | 0.004 | | | | 10.5 | 10.8 | 28.0 |
| A04 | 13 | 13 | | | 16.5 | 7.5 | 2.5 | | 0.9 | 0.5 | 0.005 | | | | 11.0 | 11.0 | 29.1 |
| A05 | 12.5 | 13 | | | 16.5 | 7.5 | 2.4 | | 0.5 | 0.9 | 0.004 | | | | 10.6 | 11.0 | 28.8 |
| A06 | 13 | 13 | | | 16.5 | 7.5 | 2.4 | | 0.4 | 0.6 | 0.013 | | | | 10.1 | 10.9 | 28.6 |
| A07 | 12 | 14 | | | 13 | 6.5 | 2.5 | | 0.6 | 0.4 | 0.004 | | | | 13.1 | 10.7 | 27.8 |
| A08 | 17 | 8 | | | 21 | 6 | 3.0 | | 0.4 | 0.5 | 0.006 | | | | 10.0 | 11.2 | 30.0 |
| A09 | 13 | 13 | | | 14 | 8 | 1.4 | | 0.7 | 0.8 | 0.007 | | | | 10.3 | 10.8 | 27.8 |
| A10 | 13 | 9.5 | | | 13 | 7.5 | 2.5 | | 0.5 | 0.5 | 0.006 | | | | 10.4 | 10.8 | 28.1 |
| A11 | 14 | 13.5 | | | 14 | 6.5 | 2.2 | | 0.5 | 0.7 | 0.004 | | | | 12.4 | 10.7 | 27.9 |
| A12 | 11 | 13 | | | 15 | 6.5 | 2.5 | | 0.4 | 0.5 | 0.006 | | | Ce 2 | 10.2 | 10.9 | 28.4 |
| A13 | 14 | 10 | 2 | | 16 | 7 | 2.7 | | 0.3 | 0.5 | 0.007 | | | | 12.0 | 11.1 | 29.5 |
| A14 | 13 | | 13 | | 16 | 6.5 | 2.5 | | 0.5 | 0.4 | 0.008 | | | | 14.2 | 10.8 | 28.3 |
| A15 | 14 | | | 11.5 | 16 | 6.5 | 2.5 | | 0.3 | 0.4 | 0.007 | | | | 12.6 | 10.7 | 27.8 |

TABLE 1-continued

[Examples]

| No | Chemical Composition (wt %) Sm | Nd | Pr | Y | Fe | Cu | Zr | Hf | Mn | Ti | B | P | S | Others | Magnetic Properties iHe (KOe) | Br (KG) | BHmax (MGOe) |
|---|---|---|---|---|---|---|---|---|---|---|---|---|---|---|---|---|---|
| A16 | 14 | | 7 | 4.5 | 17 | 6 | 2.4 | | 0.4 | 0.3 | 0.009 | | | | 10.8 | 11.0 | 29.2 |
| A17 | 13.5 | | 13 | | 16.5 | 7 | | 2.5 | 0.4 | 0.4 | 0.007 | | | | 13.5 | 10.8 | 28.2 |
| A18 | 13 | | | 12 | 17 | 6.5 | 1.5 | 1.0 | 0.4 | 0.3 | 0.008 | | | | 11.1 | 10.9 | 28.4 |
| A19 | 13 | | 11 | | 16 | 6.5 | | | 0.4 | 0.3 | 0.008 | | | Ce 2.0 | 13.8 | 10.6 | 27.8 |
| A20 | 13 | 12.5 | | | 16 | 6.5 | 2.5 | | 0.6 | 0.4 | | 0.008 | | | 11.4 | 10.9 | 28.7 |
| A21 | 13 | | 12.5 | | 16 | 6.5 | 2.5 | | 0.7 | 0.5 | | 0.009 | | | 12.5 | 10.2 | 28.4 |
| A22 | 13 | | | 12.5 | 16 | 6.5 | 2.5 | | 0.6 | 0.4 | | 0.008 | | | 10.7 | 10.7 | 27.8 |
| A23 | 15 | 4 | 4.5 | 2.5 | 15.5 | 7.3 | 2.3 | | 0.5 | 0.6 | | 0.007 | | | 14.2 | 10.6 | 27.6 |
| A24 | 14 | 6 | 5.5 | | 17 | 6 | 2.7 | | 0.4 | 0.5 | | 0.006 | | | 13.3 | 11.1 | 29.6 |
| A25 | 14 | | 6 | 5.5 | 17 | 6 | 2.7 | | 0.4 | 0.5 | | 0.008 | | | 13.5 | 10.9 | 29.0 |
| A26 | 14 | 6 | | 5.5 | 17 | 6 | 2.6 | | 0.4 | 0.5 | | 0.007 | | | 11.2 | 11.2 | 30.0 |
| A27 | 14 | 11.5 | | | 16 | 6.5 | | 2.3 | 0.4 | 0.4 | | 0.007 | | | 10.3 | 10.7 | 27.8 |
| A28 | 14 | 11.5 | | | 16 | 6.5 | 2.6 | | 0.4 | 0.5 | | | 0.007 | | 11.6 | 10.8 | 28.6 |
| A29 | 13.5 | | 6.5 | 5.5 | 15.5 | 6 | 1.5 | 1.0 | 0.5 | 0.4 | | 0.008 | | | 11.3 | 10.6 | 27.4 |
| A30 | 14 | 6.5 | | 5 | 17 | 6.5 | | 2.5 | 0.4 | 0.6 | | 0.006 | 0.006 | | 12.5 | 11.0 | 27.8 |
| A31 | 14 | 10 | | | 16 | 6.5 | 2.7 | | 0.4 | 0.4 | | 0.008 | | Ce 2 | 11.4 | 10.7 | 27.5 |
| A32 | 11 | 8 | 5 | 2 | 17 | 6.5 | 2.5 | | 0.5 | 0.4 | 0.010 | | | | 13.7 | 10.7 | 28.3 |
| A33 | 13 | 6 | 5 | 3 | 16 | 7 | 2.5 | | 0.4 | 0.4 | 0.008 | | | Ce 2 | 13.0 | 10.6 | 28.1 |
| A34 | 10.5 | 6 | 5 | 3.5 | 17 | 6 | 2.5 | | 0.5 | 0.4 | 0.008 | | | Ce 2 | 12.5 | 10.6 | 28.4 |
| A35 | 13 | 12.5 | | | 16 | 6.5 | 2.5 | | 0.4 | 0.4 | 0.006 | 0.004 | | | 11.2 | 10.8 | 28.5 |
| A36 | 13 | | 13.0 | | 16.5 | 6.5 | 2.5 | | 0.5 | 0.4 | 0.007 | 0.004 | | | 12.3 | 10.7 | 28.4 |
| A37 | 13 | | | 12.5 | 15.5 | 7.5 | 2.5 | | 0.6 | 0.4 | 0.005 | 0.005 | | | 13.3 | 10.5 | 27.7 |
| A38 | 15 | 5.0 | 5.5 | | 15.5 | 7.5 | 2.3 | | 0.3 | 0.5 | 0.004 | 0.005 | | | 12.5 | 10.8 | 28.9 |
| A39 | 13 | 10.5 | | | 16.5 | 7.5 | 2.5 | | 0.5 | 0.5 | 0.005 | 0.004 | | Ce 3 | 14.0 | 10.7 | 28.1 |
| A40 | 12.5 | | 10 | | 16.5 | 7.5 | 2.4 | | 0.5 | 0.4 | 0.004 | 0.005 | | Ce 3 | 13.6 | 10.8 | 28.8 |
| A41 | 13 | 8 | 4 | | 16 | 6.5 | 2.4 | | 0.4 | 0.6 | 0.006 | 0.004 | | Ce 3 | 13.1 | 10.9 | 28.6 |
| A42 | 13 | 12.5 | | | 16 | 6.5 | 2.5 | | 0.6 | 0.4 | 0.004 | | 0.005 | | 11.1 | 10.7 | 27.8 |

TABLE 2

[Comparative Examples and Prior art]

| No | Chemical Composition (wt %) Sm | Nd | Pr | Y | Fe | Cu | Zr | Hf | Mn | Ti | B | P | S | Others | Magnetic Properties iHe (KOe) | Br (KG) | BHmax (MGOe) |
|---|---|---|---|---|---|---|---|---|---|---|---|---|---|---|---|---|---|
| B01 | 13.5 | 13 | | | 15 | 7 | 2.7 | | | | | | | | 6.3 | 10.4 | 22.6 |
| B02 | 13.5 | 12.5 | | | 16 | 7 | 2.7 | | 0.5 | 0.4 | | | | | 13.8 | 10.8 | 25.2 |
| B03 | 13 | 13 | | | 16 | 7.5 | 2.6 | | | 0.3 | 0.007 | | | | 11.6 | 10.8 | 24.1 |
| B04 | 13 | 13 | | | 16.5 | 7 | 2.8 | | 0.6 | | 0.009 | | | | 7.6 | 11.1 | 23.8 |
| B05 | 12 | 13 | | | 16 | 7 | 2.4 | | 0.7 | | | | | | 8.0 | 10.8 | 23.5 |
| B06 | 13.5 | 12.5 | | | 16.5 | 6.5 | 2.4 | | | 0.7 | | | | | 10.7 | 10.7 | 24.6 |
| B07 | 13 | 13 | | | 16 | 7 | 2.5 | | | | 0.005 | | | | 6.2 | 10.6 | 24.0 |
| B08 | 13.5 | 12.5 | | | 16.5 | 7 | 2.8 | | | | | | | Al 0.3 | 7.0 | 10.8 | 24.1 |
| B09 | 13.5 | 12.5 | | | 16 | 7 | 2.4 | | | | | | | Cr 0.4 | 8.2 | 11.0 | 25.2 |
| B10 | 13.5 | 12.5 | | | 16.5 | 7 | 2.5 | | | | | | | V 0.6 | 6.5 | 10.7 | 24.8 |
| B11 | 13.5 | 12.5 | | | 16 | 7 | 2.4 | | | | | | | Mo 0.6 | 6.0 | 10.4 | 23.5 |
| B12 | 13 | 13 | | | 16 | 6.5 | 2.6 | | | | | | | Nb 0.5 | 8.9 | 10.8 | 25.5 |
| B13 | 7 | 16 | | | 15 | 6.5 | 2.5 | | 0.3 | 0.4 | 0.005 | | | | 6.8 | 10.4 | 20.3 |
| B14 | 13 | 13 | | | 16 | 7.5 | 2.4 | | 1.3 | 0.5 | 0.007 | | | | 9.3 | 10.8 | 22.8 |
| B15 | 13.5 | 12 | | | 16 | 7 | 2.7 | | 0.6 | 1.3 | 0.004 | | | | 12.2 | 10.6 | 24.5 |
| B16 | 13 | 12.5 | | | 16.5 | 7 | 2.4 | | 0.4 | 0.5 | 0.020 | | | | 5.6 | 11.0 | 23.7 |
| B17 | 9 | 21 | | | 15 | 6 | 2.2 | | 0.3 | 0.5 | 0.006 | | | | 4.5 | 9.8 | 15.4 |
| B18 | 15 | 15 | | | 16 | 7 | 2.5 | | 0.5 | 0.4 | 0.005 | | | | 10.6 | 9.9 | 20.5 |
| B19 | 11 | 10 | | | 15 | 6 | 2.4 | | 0.5 | 0.4 | 0.004 | | | | 6.3 | 10.1 | 19.6 |
| B20 | 13.5 | | 12.5 | | 15 | 7 | 2.5 | | | | | | | | 8.2 | 10.5 | 24.8 |
| B21 | 13 | | | 13 | 16 | 7.5 | 2.6 | | | 0.3 | 0.007 | | | | 11.6 | 10.5 | 24.1 |
| B22 | 13.5 | | | 12 | 16.5 | 6.5 | | 2.4 | | 0.5 | | | | | 9.6 | 10.8 | 24.6 |
| B23 | 13 | | 13 | | 16 | 7 | 2.6 | | | | 0.007 | | | | 7.2 | 10.6 | 23.9 |
| B24 | 13.5 | | 12.5 | | 16 | 6.5 | 2.5 | | 0.5 | 0.4 | | | | | 13.1 | 10.7 | 24.9 |
| B25 | 13 | 6.5 | 6.0 | | 16.5 | 6 | 2.8 | | | 0.3 | | 0.007 | | | 10.6 | 10.8 | 24.8 |
| B26 | 13 | 7 | | 5.5 | 16.5 | 7 | 2.8 | | 0.4 | | | | 0.008 | | 7.8 | 10.5 | 25.6 |
| B27 | 13.5 | | 6.5 | 6.0 | 16.5 | 6.5 | | 2.3 | | 0.6 | | | | | 11.5 | 10.6 | 24.7 |
| B28 | 13 | 13 | | | 16 | 7 | 2.5 | | | | | 0.010 | | | 5.5 | 10.6 | 23.9 |
| B29 | 13.5 | | | 12 | 16 | 7 | 2.7 | | 0.6 | 1.4 | | 0.008 | | | 14.4 | 10.2 | 23.4 |
| B30 | 13 | | 12.5 | | 16.5 | 7 | 2.4 | | 0.4 | 0.5 | | 0.020 | | | 5.4 | 10.6 | 23.9 |
| B31 | 8 | 12 | | | 15 | 6 | 2.5 | | 0.4 | 0.5 | | | 0.006 | | 7.8 | 10.4 | 24.3 |
| C01 | 14.7 | 5.8 | 2 | | 14.8 | 5 | 2.3 | | | | | | | Ce 2 | bHc 7.6 | 10.6 | 24.2 |

Further, by the addition of Mn and B, the optimum range for the sintering temperature and the solubilizing temperature can be extended, to reduce the scattering of the quality due to the temperature variation in the above-mentioned steps in the industrial production. Further, in the alloys in which Nd, Pr, Y is added by an appropriate amount to Sm, grinding property is improved to reduce the occurrence of cracking or chipping, the yield of the products can be improved.

On the contrary, in rare earth magnet alloys of the comparative examples, the alloys of Nos. B01, B08–B12 contained 13 to 13.5% of Sm and 12.5 to 13% of Nd but none of Mn, Ti, B, P and S. Alloys of Nos. B07 and B28 have substantially the same contents of Sm and Nd as in the alloys of Nos. B01, B08–B12 but contain none of Mn or Ti. Thus, these alloys are remarkably poor in the coercive force. The alloy of No. B15 contains 13.5% of Sm and 12% of Nd but contains 1.3% of Ti, by which the maximum energy product is reduced. The alloy of No. B13 contains 7% of Sm, which is lower than that of the alloy in the present invention and is poor in the coercive force. The alloy of No. B18 contains Sm and Nd by 30% in total and shows an excellent coercive force but it is poor in the maximum energy product.

In comparative examples containing one or more of Pr and Y together with Sm, alloys of Nos. B21 and B27 have excellent coercive force of greater than 10 KOe respectively by the containment of Ti, But the maximum energy product is as low as 24.1 and 24.7 MGOe respectively since they do not contain Mn.

In comparative examples containing one or two of Pr and Y together with Sm and Nd, alloys No. B24 and B25 show excellent coercive force of greater than 10 KOe by the containment of Ti, but since they do not contain one of B, P and S or Mn, the maximum energy product is as low as 24.9 MGOe and 24.8 MGOe respectively.

Other comparative examples show low coercive force and maximum energy product. In the prior art of No. C01, although the total sum of the amounts for the rare earth metals reaches as great as 22.5%, they contain none of Mn, Ti, B, P and S, having the coercive force of less than 10 KOe and the maximum energy product of as low as 24.2 MgOe.

On the contrary, examples of the present invention have coercive force of not less than 10 KOe, residual flux density of not less than 10.5 KG and the maximum energy product of about 28 MGOe and it is confirmed that rare earth magnet alloys having excellent magnetic property can be obtained. Further, it has also been confirmed that the optimum ranges for the sintering temperature and the solubilizing temperature can be made broader due to the addition of Mn, B, P or S, to reduce the scattering of quality due to the variation of temperature in the sintering or solubilizing step in the industrial production. Further, it has also been found that the grinding property can be improved in the alloy according to the present invention, which can reduce the occurrence of cracking or chipping to improve the yield of the products.

What is claimed is:

1. A rare earth magnet alloy consisting essentially of, by weight, 8–20% of Sm, 6–20% of one or more of elements selected from the group consisting of Nd, Pr and Y, 10–25% of Fe, 5–10% of Cu, 0.1–1.0% of Ti, 1–4% of Zr, 0.1–1.0% of Mn, 0.003–0.015% of B, and remainder being Co, with a proviso that the total sum of the amount of elements selected from the group consisting of Nd, Pr and Y and the amount of Sm is within a range from 22% to 28%.

2. A magnet alloy according to claim 1, wherein the amount of Nd is 6–20% and the total sum of the amounts of Sm and Nd is 22–28%.

3. A magnet alloy according to claim 1, wherein the amount of Pr is 6–20% and the total sum of the amounts of Sm and Pr is 22–28%.

4. A magnet alloy according to claim 1, wherein the amount of Y is 6–20% and the total sum of the amounts of Sm and Y is 22–28%.

5. A magnet alloy according to claim 1, wherein the total sum of amounts of Nd and Pr is 6–20% and the total sum of amounts of Sm, Nd and Pr is 22–28%.

6. A magnet alloy according to claim 1, wherein the total sum of amounts of Nd and Y is 6–20% and the total sum of amounts of Sm, Nd and Y is 22–28%.

7. A magnet alloy according to claim 1, wherein the total sum of amounts of Pr and Y is 6–20% and the total sum of amounts of Sm, Pr and Y is 22–28%.

8. A magnet alloy according to claim 1, wherein the total sum of amounts of Nd, Pr and Y is 6–20% and the total sum of amounts of Sm, Nd, Pr and Y is 22–28%.

9. A magnet alloy according to claim 2, wherein the alloy further includes less than 5% of Ce, and the total sum of amounts of Nd and Ce is 6–20% and the total sum of amounts of Sm, Nd and Ce is 22–28%.

10. A magnet alloy according to claim 3, wherein the alloy further includes less than 5% of Ce, and the total sum of amounts of Pr and Ce is 6–20% and the total sum of amounts of Sm, Pr and Ce is 22–28%.

11. A magnet alloy according to claim 5, wherein the alloy further includes less than 5% of Ce, and the total sum of amounts of Nd, Pr and Ce is 6–20% and the total sum of amounts of Sm, Nd, Pr and Ce is 22–28%.

12. A magnet alloy according to claim 6, wherein the alloy further includes less than 5% of Ce, and the total sum of amounts of Nd, Y and Ce is 6–20% and the total sum of amounts of Sm, Nd, Y and Ce is 22–28%.

13. A magnet alloy according to claim 7, wherein the alloy further includes less than 5% of Ce, and the total sum of amounts of Pr, Y and Ce is 6–20% and the total sum of amounts of Sm, Pr, Y and Ce is 22–28%.

14. A magnet alloy according to claim 8, wherein the alloy further includes less than 5% of Ce, and the total sum of amounts of Nd, Pr, Y and Ce is 6–20% and the total sum of amounts of Sm, Nd, Pr, Y and Ce is 22–28%.

15. A rare earth magnet alloy consisting essentially of, by weight, 8–20% of Sm, 6–20% of one or more of elements selected from the group consisting of Nd, Pr and Y, 10–25% of Fe, 5–10% of Cu, 0.1–1.0% of Ti, 1–4% of Zr, 0.1–1.0% of Mn, 0.003–0.015% of one or more of elements selected from the group consisting of P and S, and remainder being Co, with a proviso that the total sum of the amount of elements selected from the group consisting of Nd, Pr and Y and the amount of Sm is within a range from 22% to 28%.

16. A magnet alloy according to claim 15, wherein the amount of Nd is 6–20% and the total sum of the amounts of Sm and Nd is 22–28%.

17. A magnet alloy according to claim 15, wherein the amount of Pr is 6–20% and the total sum of the amounts of Sm and Pr is 22–28%.

18. A magnet alloy according to claim 15, wherein the amount of Y is 6–20% and the total sum of the amounts of Sm and Y is 22–28%.

19. A magnet alloy according to claim 15, wherein the total sum of the amounts of Nd and Pr is 6–20% and the total sum of amounts of Sm, Nd and Pr is 22–28%.

20. A magnet alloy according to claim 15, wherein the total sum of amounts of Nd and Y is 6–20% and the total sum of amounts of Sm, Nd and Y is 22–28%.

21. A magnet alloy according to claim 15, wherein the total sum of amounts of Pr and Y is 6–20% and the total sum of amounts of Sm, Pr and Y is 22–28%.

22. A magnet alloy according to claim 15, wherein the total sum of amounts of Nd, Pr and Y is 6–20% and the total sum of amounts of Sm, Nd, Pr and Y is 22–28%.

23. A magnet alloy according to claim 16, wherein the alloy further includes less than 5% of Ce, and the total sum of the amounts of Nd and Ce is 6–20% and the total sum of amounts of Sm, Nd and Ce is 22–28%.

24. A magnet alloy according to claim 17, wherein the alloy further includes less than 5% of Ce, and the total sum of the amounts of Pr and Ce is 6–20% and the total sum of amounts of Sm, Pr and Ce is 22–28%.

25. A magnet alloy according to claim 19, wherein the alloy further includes less than 5% of Ce, and the total sum of amounts of Nd, Pr and Ce is 6–20% and the total sum of amounts of Sm, Nd, Pr and Ce is 22–28%.

26. A magnet alloy according to claim 20, wherein the alloy further includes less than 5% of Ce, and the total sum of amounts of Nd, Y and Ce is 6–20% and the total sum of amounts of Sm, Nd, Y and Ce is 22–28%.

27. A magnet alloy according to claim 21, wherein the alloy further includes less than 5% of Ce, and the total sum of amounts of Pr, Y and Ce is 6–20% and the total sum of amounts of Sm, Pr, Y and Ce is 22–28%.

28. A magnet alloy according to claim 22, wherein the alloy further includes less than 5% of Ce, and the total sum of amounts of Nd, Pr, Y and Ce is 6–20% and the total sum of amounts of Sm, Nd, Pr, Y and Ce is 22–28%.

29. A rare earth magnet alloy consisting essentially of, by weight, 8–20% of Sm, 6–20% of one or more of elements selected from the group consisting of Nd, Pr and Y, 10–25% of Fe, 5–10% of Cu, 0.1–1.0% of Ti, 1–4% of Zr, 0.1–1.0% of Mn, 0.003–0.015% of B and 0.003–0.015% of one or more of elements selected from the group consisting of P and S, and remainder being Co, with a proviso that the total sum of the amount of elements selected from the group consisting of Nd, Pr and Y and the amount of Sm is within a range from 22% to 28% and the total sum of the amount of B, P and S is less than 0.015%.

30. A magnet alloy according to claim 29, wherein the amount of Nd is 6–20% and the total sum of the amounts of Sm and Nd is 22–28%.

31. A magnet alloy according to claim 29, wherein the amount of Pr is 6–20% and the total sum of the amounts of Sm and Pr is 22–28%.

32. A magnet alloy according to claim 29, wherein the amount of Y is 6–20% and the total sum of the amounts of Sm and Y is 22–28%.

33. A magnet alloy according to claim 29, wherein the total sum of amounts of Nd and Pr is 6–20% and the total sum of amounts of Sm, Nd and Pr is 22–28%.

34. A magnet alloy according to claim 29, wherein the total sum of amounts of Nd and Y is 6–20% and the total sum of amounts of Sm, Nd and Y is 22–28%.

35. A magnet alloy according to claim 29, wherein the total sum of amounts of Pr and Y is 6–20% and the total sum of amounts of Sm, Pr and Y is 22–28%.

36. A magnet alloy according to claim 29, wherein the total sum of amounts of Nd, Pr and Y is 6–20% and the total sum of amounts of Sm, Nd, Pr and Y is 22–28%.

37. A magnet alloy according to claim 30, wherein the alloy further includes less than 5% of Ce, and the total sum of amounts of Nd and Ce is 6–20% and the total sum of amounts of Sm, Nd and Ce is 22–28%.

38. A magnet alloy according to claim 31, wherein the alloy further includes less than 5% of Ce, and the total sum of amounts of Pr and Ce is 6–20% and the total sum of amounts of Sm, Pr and Ce is 22–28%.

39. A magnet alloy according to claim 33, wherein the alloy further includes less than 5% of Ce, and the total sum of amounts of Nd, Pr and Ce is 6–20% and the total sum of amounts of Sm, Nd, Pr and Ce is 22–28%.

40. A magnet alloy according to claim 34, wherein the alloy further includes less than 5% of Ce, and the total sum of amounts of Nd, Y and Ce is 6–20% and the total sum of amounts of Sm, Nd, Y and Ce is 22–28%.

41. A magnet alloy according to claim 35, wherein the alloy further includes less than 5% of Ce, and the total sum of amounts of Pr, Y and Ce is 6–20% and the total sum of amounts of Sm, Pr, Y and Ce is 22–28%.

42. A magnet alloy according to claim 36, wherein the alloy further includes less than 5% of Ce, and the total sum of amounts of Nd, Pr, Y and Ce is 6–20% and the total sum of amounts of Sm, Nd, Pr, Y and Ce is 22–28%.

* * * * *